US005333667A

United States Patent [19]

Louat et al.

[11] Patent Number: 5,333,667

[45] Date of Patent: Aug. 2, 1994

[54] SUPERSTRENGTH METAL COMPOSITE MATERIAL AND PROCESS FOR MAKING THE SAME

[75] Inventors: Norman P. Louat, Alexandria, Va.; Virgil Provenzano, Bethesda, Md.; M. Ashraf Imam, Annadale; Kuntimaddi Sadananda, Springfield, both of Va.

[73] Assignee: The United States of America as represented by the Secretary of the Navy, Washington, D.C.

[21] Appl. No.: 828,630

[22] Filed: Jan. 31, 1992

[51] Int. Cl.[5] ..... B22D 19/14

[52] U.S. Cl. ..... 164/97; 164/61; 164/112

[58] Field of Search ..... 164/97, 98, 112, 76.1, 164/61, 91, 103, 105

[56] References Cited

U.S. PATENT DOCUMENTS

| | | | |
|---|---|---|---|
| 4,108,236 | 8/1978 | Salkeld | 164/128 |
| 4,254,621 | 3/1981 | Nagumo | 164/97 |
| 4,279,289 | 7/1981 | Ban | 164/97 |
| 4,312,398 | 1/1982 | Van Blunk | 164/108 |
| 4,365,997 | 12/1982 | Jachowski | 164/59.1 |
| 5,004,036 | 4/1991 | Becker | 164/97 |

OTHER PUBLICATIONS

Pressure Infiltration Casting of Metal Matrix Composites, A. J. Cook, A144 (Oct. 1991) 189-206.

*Primary Examiner*—P. Austin Bradley
*Assistant Examiner*—Rex E. Pelto
*Attorney, Agent, or Firm*—Thomas E. McDonnell; Barry A. Edelberg

[57] ABSTRACT

A metal composite material provides improved strength at all temperatures, in particular at those temperatures greater half the melting point of its matrix. The metal composite material is at least 50 volume percent hard particulate material in a matrix which is significantly more ductile than the hard particulate material. At or above 50 volume percent hard particulate material, each particle is surrounded by a thin film of the matrix material. This thin film resists deformation by converting sliding motion between particles into the rotational motion of the particles about each other. The matrix may be made by infiltrating a powder of the particulate material with a charge of the matrix material, for example, by hot isostatically pressing the matrix material into the powder or by melting a block of matrix material on top of the powder and thus infiltrating the powder by gravitational flow of the melted matrix material into the powder.

12 Claims, 5 Drawing Sheets

SUPERSTRENGTH METAL COMPOSITE MATERIAL AND PROCESS FOR MAKING THE SAME

FIELD OF THE INVENTION

The present invention relates to a method of making a superstrength metal composite material and to the material made by that method.

BACKGROUND OF THE INVENTION

In making high performance devices such a turbine engines, it is important to use materials which are strong, especially at high temperatures. The strength of any material is defined as its resistance to deformation. On an atomic scale, resistance to deformation in a crystalline material corresponds to its resistance to dislocation motion. Dislocation motion, in turn, is resisted by internal stresses. Therefore, in order to achieve maximum strength, the internal stresses in the material should meet the following requirements: act in unison, be as large as possible, not be easily avoidable, and not be thermally surmountable at significant rates.

Mechanisms or techniques used to strengthen conventional alloys include hardening by solid solutions, precipitation and dispersion of particles and strain hardening. However, none of these mechanisms meet all the requirements listed above and thus these mechanisms do not maximize strength. Importantly, conventional strengthening mechanisms lose their effectiveness at high temperature due to thermally activated processes such as creep. For example, when the nickel based superalloys used in turbine engines are strengthened by conventional schemes, the superalloys lose nearly all of their strength at temperatures between seven to eight tenths of the melting point of the nickel matrix. Consequently, in order to obtain dramatic increases in the strength of metal composite materials a new and revolutionary approach is needed.

A key object of the invention to produce a metal composite material which has increased strength at a temperature which is greater than half the melting temperature of one of its component materials.

The present invention concerns a metal composite material of improved strength as well as a process for making the material. The metal composite material according to the invention has a unique structure. In this material, over 50 volume percent is a hard particulate, and the remainder is metal matrix that is significantly more ductile than the particulate material. The particulate and matrix material should be capable of wetting each other, but are preferably inert to each other. In this matrix, each particle is essentially surrounded by a thin coating of the matrix material. By virtue of this thin coating between the particles, deformation caused, for example, by pulling, is translated into rotational movement of the particles about each other, even at high temperature. The translation of deformation stresses into this rotational movement greatly enhance the resistance of the composite to deformation.

In one embodiment, the material composite of this invention is made by placing particles of one material inside a hollow cylinder of a metal matrix material to form a mixture which is greater than 50% particles by volume. The two materials are chosen so that they capable of wetting each other and are essentially immiscible in the solid state. After capping the cylinder with a piece of the matrix material, the cylinder is wrapped in foil and placed in a vacuum resistant jacket. Then air is evacuated from the jacket to form a vacuum. After being evacuated, the jacket is hot isostatically pressed at a temperature above the melting temperature of the matrix material to form a metal composite material having improved strength.

In another embodiment, the composite may be formed by placing a crucible containing the particulate material within a chamber which is evacuated to remove any trapped air or other gas from the spaces between the particles. Within the chamber and above the particulate material is a block of a metal, for example copper. The metal block above the particulate material is heated to above its melting temperature but below the melting temperature of the particulate material. Gravity causes the molten metal to flow downward and infiltrate the particulate material in the crucible.

In a preferred embodiment the particles are less than a micron in size. Additionally, the hot isostatic pressing process may include a second hot isostatic pressing at a temperature below the melting point of the matrix material to give even more strength to the material.

Other features and advantages of the invention will be set forth in, or apparent from, the following detailed description of the preferred embodiments of the invention.

DETAILED DESCRIPTION OF THE INVENTION

The process according to invention is capable of increasing the strength of the metal matrix material by as much as 100 times at elevated temperatures. Depending on the matrix material used, the composite material of the invention is capable of being used in high temperature gas turbine engines for improved efficiency and performance, as a light-weight, high strength material for advanced aerospace systems, and as a high-strength material for other military and civilian applications.

The process by producing the superstrength composite material of the invention comprises the following steps. First, a powder of hard particles is placed inside a hollow cylinder of a ductile metal matrix material. The cylinder is then capped but not sealed with a piece of the same ductile metal material as the cylinder. The sealed cylinder is wrapped with a foil which is non-reactive with the metal cylinder. Then the wrapped cylinder is placed inside a Jacket which is evacuated over a period of time, generally one or more hours. Next, the evacuated jacket is heated or hot isostatically pressed (HIP) first above and then, if necessary, below the melting temperature of the metal cylinder in order to infiltrate the matrix into the interstices of the particulate material. Finally the consolidated material is removed from the jacket and the wrapping foil.

In the hot isostatic pressing, the jacket is placed in a chamber in which pressure is applied by means of a gas. While many types of gases may be used, inert gases such as argon are preferred because they do not react with the jacket or the material inside. During isostatic pressing, the difference in pressure between that in the jacket and that in the chamber promotes the rate of infiltration. Although the precise pressure used to be used is dependent on the materials used and the size of the particles, typically pressures are of the order of 70 to 350 MPa (10 to 50 ksi, ksi=one thousand pound per square inch). While it is only necessary that the cylinder be heated to a temperature above the melting point of the matrix material, for many particle and matrix material combinations, it may be desirable to carry out a hot isostatic pressing at temperature below the melting point of the matrix material.

Figure 12:
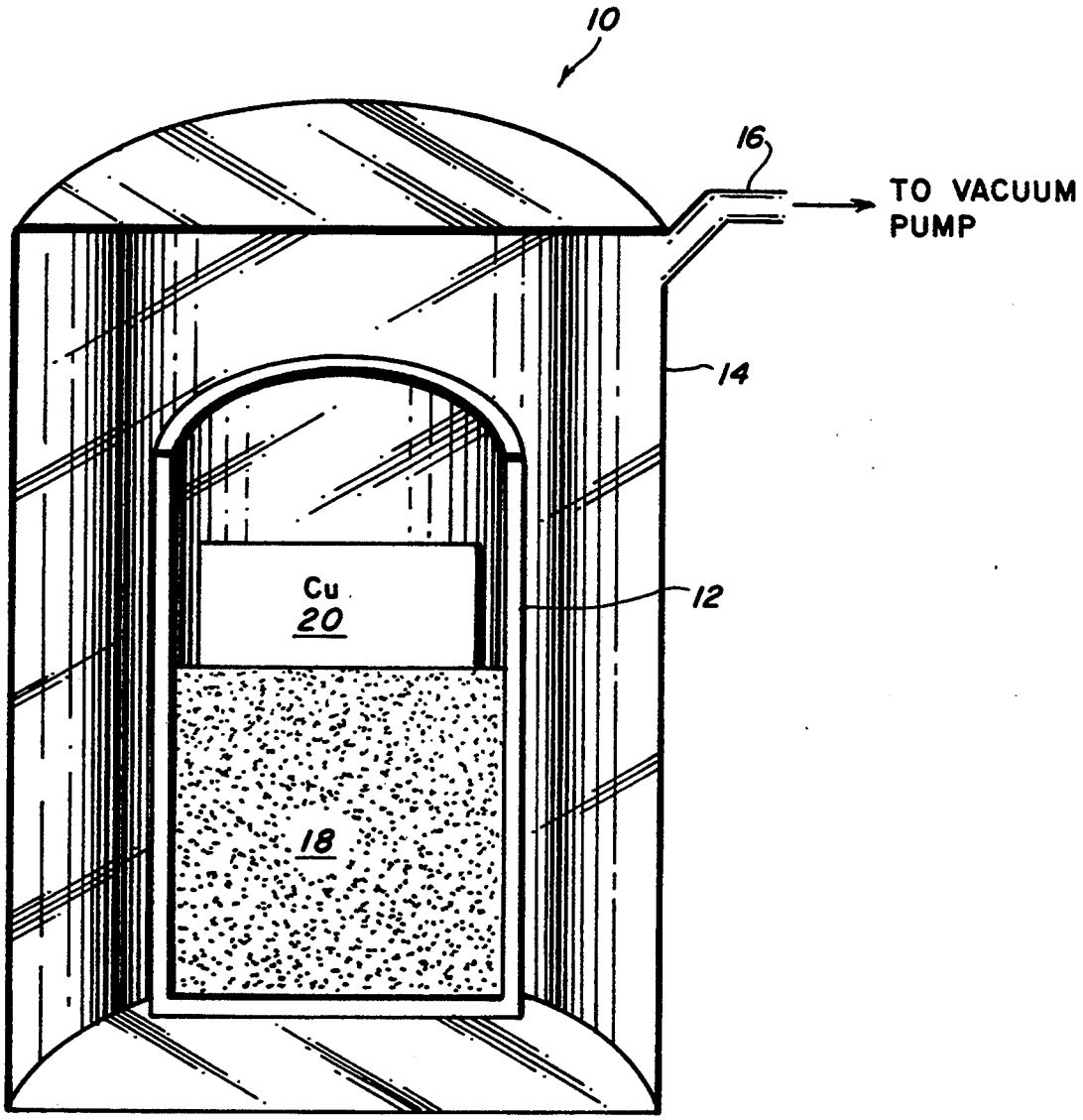
FIG. 12 is a cross-sectional view of an apparatus useful for producing the composite according to the present invention by an alternative method.

The composites according to the present invention may also be produced using an apparatus 10 as shown in FIG. 12. Crucible 12 rests within chamber 14. Sidearm 16 of chamber 14 is connected to a vacuum pump (not shown). Crucible 12 is partially filled with the particulate material 18. A block of metal 20, such as copper, is placed on the particulate material 18. The chamber 12 is evacuated through sidearm 16 to remove any trapped gases from between the particles of particulate material 18. The evacuated chamber 12 is heated to above the melting temperature of the metal block 20 but below the melting temperature of particulate material 18. The molten metal then flows, by virtue of gravity, into the particulate material 18, and infiltrates that material to form a composite.

The particles of the particulate material are generally metallic particles but may be made from other hard materials, for example, a ceramic, such as a carbide. Examples of carbides useful according to the present invention are the metal carbides. The matrix material is generally a ductile metal or alloy. Exemplary matrix materials include lead, copper, and nickel and alloys thereof. The criteria for choosing suitable particle and matrix material combinations are set forth below.

In order for the strengthening effect to be achieved, the particles and the matrix material should wet each other. Their angle of contact should be less than 90°. This requirement allows infiltration of the particulate material by the matrix material. In addition, the particles and matrix material should be sparingly soluble, preferably immiscible, in each other to prevent the particles from growing in size due to Ostwald ripening. Preventing growth in size of the particles is important, because smaller particles tend to yield stronger materials.

Preferably, the particles are small, most preferably less than 1 micron in size. The strength of the metal product produced is approximately inversely proportional to the square root of the size of the particles used.

In order to achieve the potential of the invention, particles should constitute more than 50% of the mixture of the particles and matrix material by volume. Typically, the particles constitute 60 or even 70% of the mixture by volume. The maximum percentage is dependent on the specific particles and matrix material used.

When producing the material of the present invention by hot isostatic pressing, the jacket which surrounds the cylinder during pressing may be made of any material which is vacuum sealable, capable of withstanding a vacuum at high temperature, and capable of collapsing without breaking. Preferably, the jacket is made of a metal such as steel. Additionally, the cylinder is wrapped in foil to isolate the mixture from the surrounding jacket. The wrapping foil should be made from a material which is non-reactive with the particles and the matrix material and has a higher melting point than both of them.

The following examples further illustrate the invention and are not to be considered in any way limiting.

EXAMPLE 1

Figure 1:
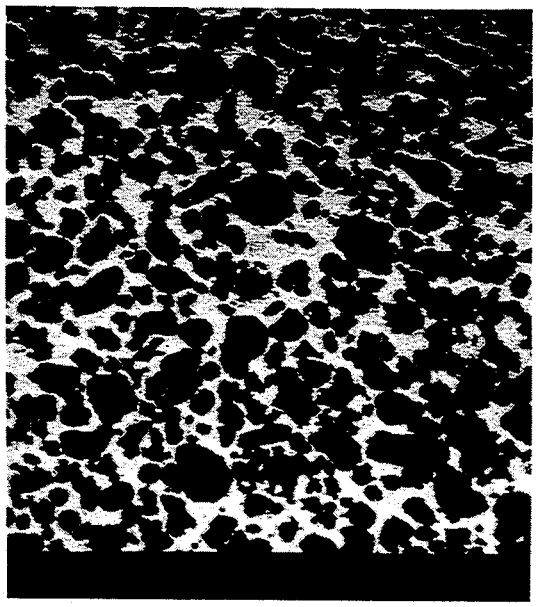
FIG. 1 shows the microstructure of iron particles infiltrated with lead by hot isostatic pressing at 400 and 300° C. at a magnification of 100X. In the micrograph the iron particles are surrounded by a lead matrix.
Figure 2:
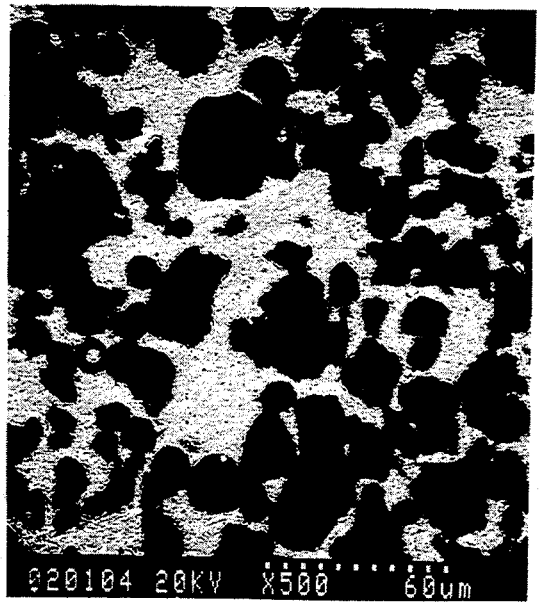
FIG. 2 shows the iron-lead mixture of FIG. 1 at a magnification of 500X.
Figure 3:
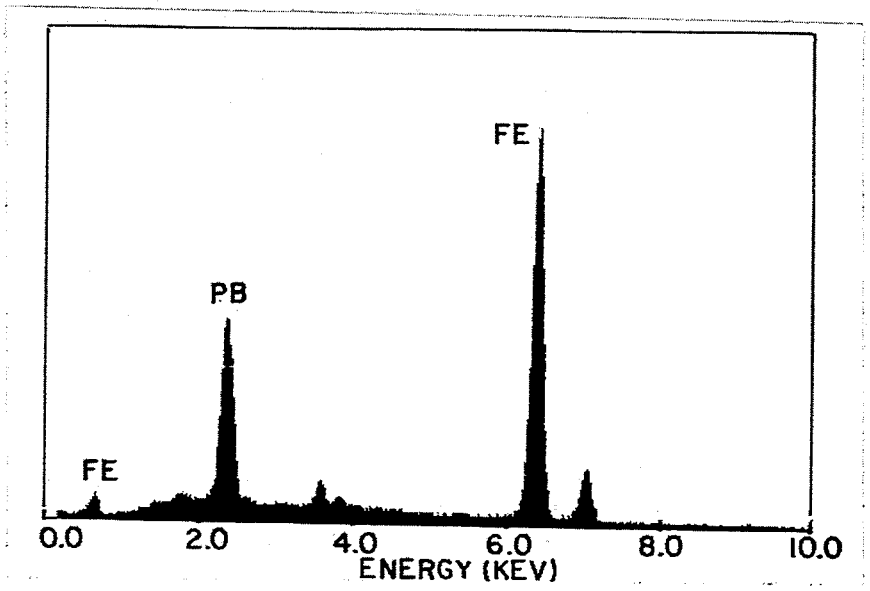
FIG. 3 shows the X-ray spectrum of the iron-lead mixture of FIGS. 1 and 2.

A powder of sub-micron size iron particles, obtained from Johnson and Mathey (hereinafter abbreviated as J&M), was placed inside a hollow cylinder (4", with i.d. of 1") made of lead. The amount of powder was that which was sufficient to fill the hollow cylinder. The cylinder was capped but not sealed with a piece of lead. The sealed cylinder was wrapped with tantalum foil and placed inside a steel jacket. The jacket was evacuated for several hours. The evacuated jacket was then hot isostatically pressed at 103 MPa (15 ksi) at 400° C. (above the melting point of lead) for 1 hour. After cooling, the evacuated jacket was hot isostatically pressed a second time at 207 Mpa (30 ksi) at 300° C. (below the melting point of lead) for 2 hours. After cooling the product produced was removed from the stainless steel bag and from the wrapping foil. The product was tested for various properties. The microstructure of the product is shown in FIGS. 1 and 2 which shows the iron particles surrounded by a lead matrix. FIG. 3 show the X-ray spectrum for the product. In order to obtain the X-ray spectrum, the product was sectioned with a diamond saw and polished by standard metallographic techniques.

EXAMPLE 2

Figure 4:
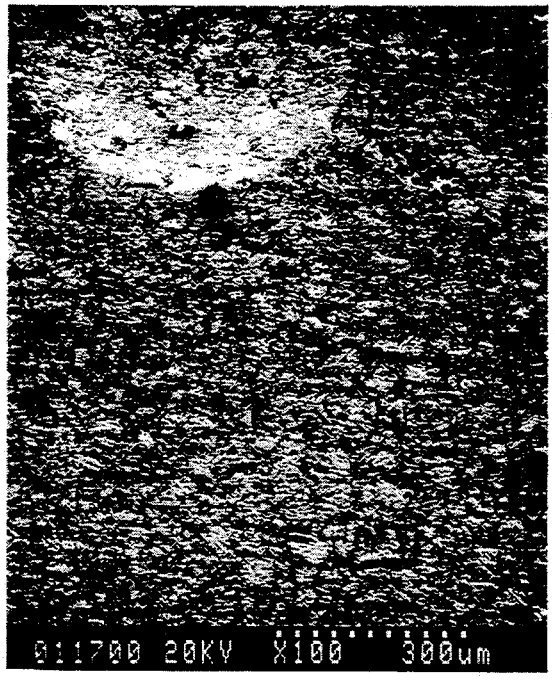
FIG. 4 shows the microstructure of tantalum carbide particles infiltrated with copper by hot isostatic pressing at 1450° C. at a magnification of 100X. In the micrograph the tantalum carbide particles are surrounded by a copper matrix.
Figure 5:
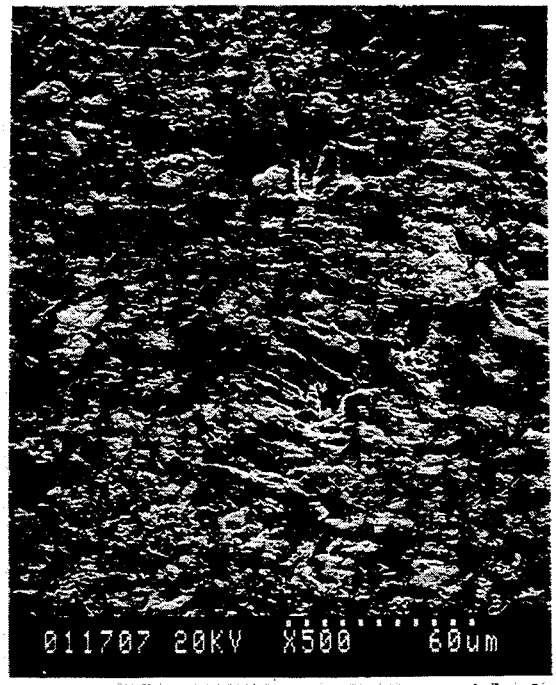
FIG. 5 shows the tantalum carbide-copper mixture of FIG. 4 at a magnification of 500X.
Figure 6:
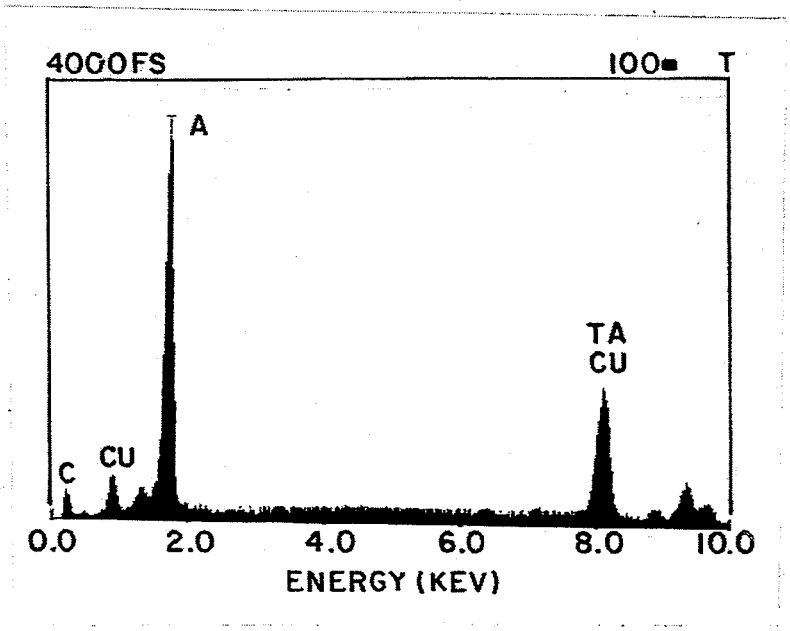
FIG. 6 shows the X-ray spectrum of the tantalum carbide-copper mixture of FIGS. 4 and 5.

A process similar to the one described above for Example 1 was carried out using sub-micron size tantalum carbide (J&M) as the metal particles and copper as the matrix material. The first hot isostatic pressing was performed at a pressure of 207 MPa (30 ksi) and at a temperature of 1300° C. for 2 hours. After cooling, a second isostatic pressing was performed at a pressure of 207 MPa at a temperature of 950° C. (below the melting point of copper) for 2 hours. FIGS. 4 and 5 show the microstructure of the product produced. FIG. 6 shows an X-ray spectrum of the product.

EXAMPLE 3

Figure 7:
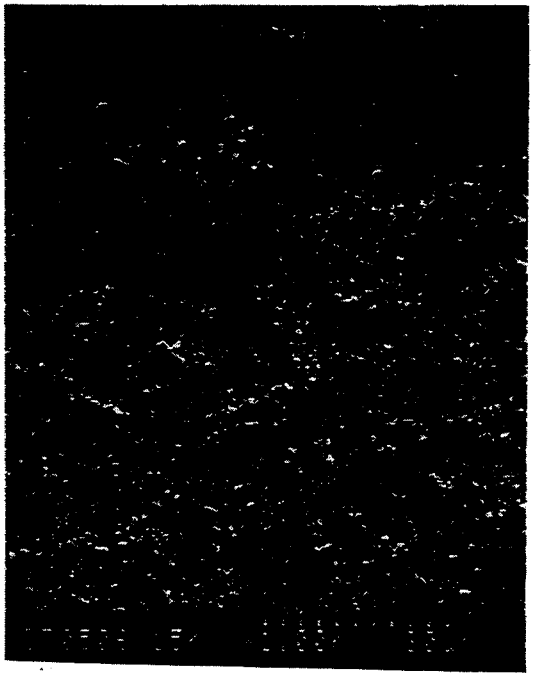
FIG. 7 shows the microstructure of titanium carbide particles infiltrated with copper by hot isostatic pressing at 1300 and 1450° at a magnification of 1000X. In the micrograph the titanium carbide particles are surrounded by a copper matrix.
Figure 8:
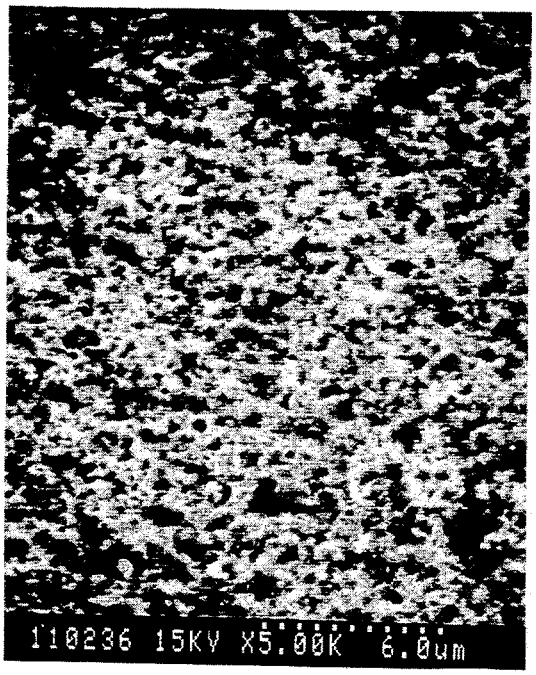
FIG. 8 shows the tantalum carbide-copper mixture of FIG. 7 at a magnification of 5000X.
Figure 9:
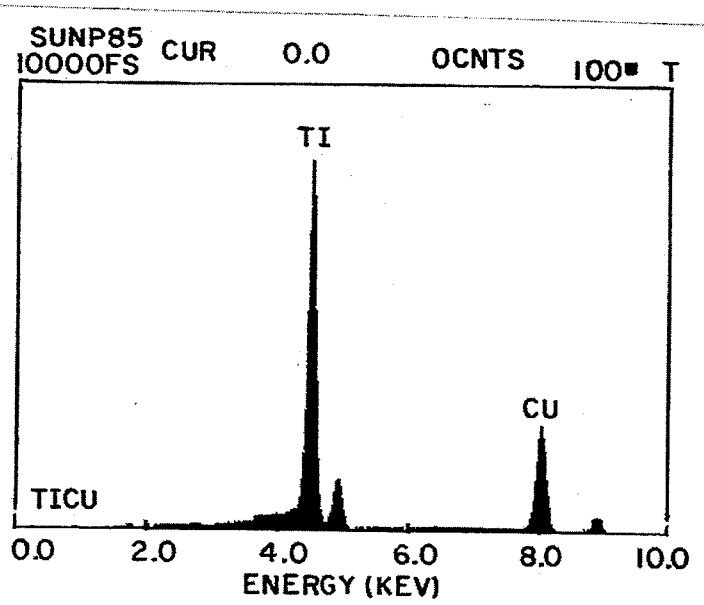
FIG. 9 shows the X-ray spectrum of the tantalum carbide-copper mixture of FIGS. 7 and 8.

A process similar to the one described above for Example 2 was carried out using sub-micron size titanium carbide (J&M) instead of tantalum carbide (J&M) as the metal particles. FIGS. 7 and 8 show the microstructure of the product produced. FIG. 9 shows an X-ray spectrum of the product. In order to determine yield strength and to obtain the X-ray spectrum, the product was sectioned with a diamond saw and polished by standard metallographic techniques. The yield strength of the polished section was determined by impression tests using a cylindrically shaped indenter of 1 mm in diameter. The yield strength measurement was conducted at room temperature {comments by inventors?}. Using 0.5 mm {comments by inventors?}) size titanium carbide particles resulted in a yield strength of 2413 MPa (350 ksi) which is 30 times the yield strength of annealed copper. [This example is a combination of information from the invention disclosure and the preprint of the journal article]

EXAMPLE 4

Figure 10:
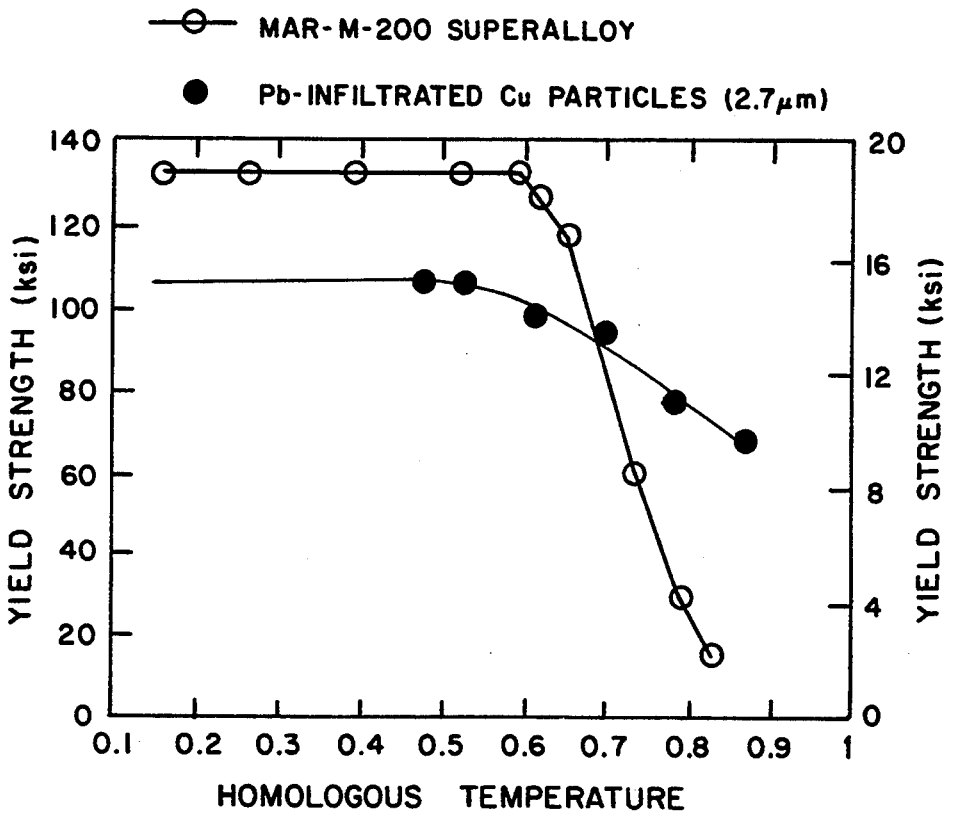
FIG. 10 is a graph comparing the yield strength copper-lead composite of the invention to a nickel based superalloy.

The procedure of Example 1 was used, except copper powder (J&M) having an average particle size of 2.7 μm was used as the particles in a lead matrix. The hot isostatic pressing was performed for 2 hours at 400° C. and for 3 hours at 300° C. The isostatic pressure for both pressings was 207 MPa (30 ksi). In order to determine yield strength the composite product was sectioned with a diamond saw and polished by standard metallographic techniques. The yield strength of the polished section was determined by impression tests using a cylindrically shaped indenter of 1 mm in diameter. The yield strength measurement was conducted at various temperatures. FIG. 10 is a plot of the yield strength of the copper-lead product as a function of the homologous temperature, where the melting point of lead is used as the reference temperature. In the same plot the yield strength as a function of the homologous temperature of dispersion and precipitation of a nickel based superalloy Mar-M-200, is shown for comparison. The reference temperature for Mar-M-200 is the melting temperature of the nickel matrix. FIG. 10 shows that the nickel based superalloy loses about 90% of its room temperature strength at about eight tenths of the melting temperature of nickel. In contrast, the copper-lead composite sample loses only about 35% of its room temperature strength at about 90% of the melting point of lead. This data shows that, whereas alloys strengthened by conventional mechanisms lose nearly all of their strength at elevated temperatures (between seven to eight tenths of the matrix metal's melting point), the superstrength materials according to the invention retain most of their strength even when the temperature is close to the melting point of the matrix.

EXAMPLE 5

Figure 11:
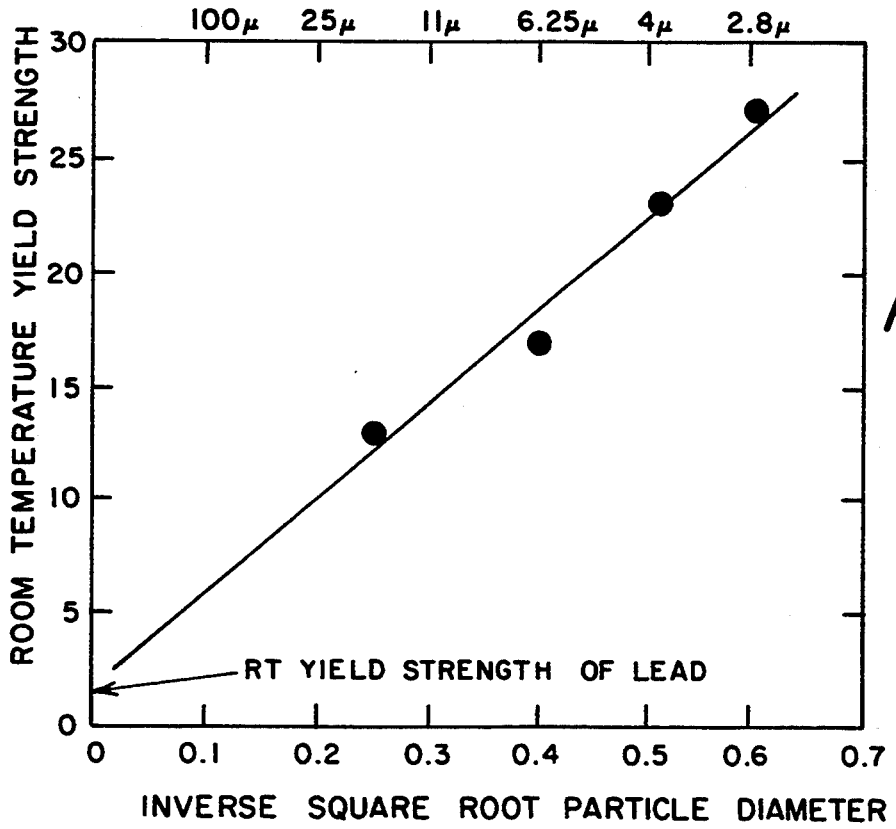
FIG. 11 is a graph showing the effect of particle size on the yield strength of composites according to the invention.

Iron-lead composite products using four different sizes of iron particles were prepared using the process of the Example 1. The products were sectioned with a diamond saw and polished by standard metallographic techniques. The yield strength of the polished sections at room temperature was then determined by impression tests using a cylindrically shaped indenter of 1 mm in diameter. FIG. 11 shows a plot of the yield strength versus the inverse square root of the particle diameter. As can be seen from this plot, yield strength varies directly with the inverse square root of the diameter (or size) of the particles.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A process for producing a strengthened metal composite material of hard particles surrounded by a metal matrix, comprising the steps of:

evacuating interstices of a powdered, hard, particulate material by applying an external vacuum to said powdered, hard particulate material, the particles of said hard particulate material having an average size of less than one micron;

infiltrating, by hot isostatic pressing, said evacuated interstices of said powdered, hard particulate material with a ductile metal which has a melting point lower than that of said powdered, hard particulate material, and which wets but is essentially nonreactive with, and essentially immiscible in the solid state with, said particulate material, to form a composite material having at least 50 volume percent of said particulate material, said particles of said hard particulate material being surrounded by a matrix of said ductile metal.

2. The process of claim 1, wherein said particulate material is a metal.

3. The process of claim 1, wherein said particulate material is a ceramic.

4. A process for producing a strengthened metal composite material of hard particles surrounded by a metallic matrix material, comprising the steps of:

(a) placing particles of a powdered particulate material having an average particle size of less than one micron inside a hollow cylinder of a metallic matrix material, the matrix material being significantly more ductile than the particles, the particles and the matrix material being essentially immiscible in the solid state, the particles comprising greater than 50% by volume of the mixture of the particles and the matrix material, and the powdered particulate material having a melting point higher than the melting point of the matrix material;

(b) capping the hollow cylinder with a piece of the matrix material;

(c) wrapping the cylinder in a foil having a melting point higher than the melting points of the particles and the matrix material;

(d) placing the foil wrapped cylinder inside a jacket which is resistant to vacuum conditions at high temperature;

(e) evacuating air from the jacket to form a vacuum inside the jacket;

(f) hot isostatically pressing the evacuated jacket at a temperature above the melting point of the matrix material, and below the melting point of the powdered particulate material, so as to produce a metal composite in which said particles of said powdered particulate material are surrounded by a metallic matrix; and (g) removing the metal composite material from the jacket and foil.

5. The process of claim 4, wherein the matrix material is lead and the jacket is first hot isostatically pressed at a temperature of about 400° C. and then hot isostatically pressed at a temperature of about 300° C.

6. The process of claim 5, wherein the matrix material is copper and the jacket is first heated to a temperature of about 1300° C. and then hot isostatically pressed at a temperature of about 950° C.

7. The process of claim 4, wherein the particles are metallic.

8. The process of claim 4, wherein the particles are iron and the matrix material is lead.

9. The process of claim 4, wherein the particles are tantalum carbide and the matrix material is copper.

10. The process of claim 4, wherein the particles are titanium carbide and the matrix is copper.

11. The process of claim 4, wherein the particles are copper and the matrix material is lead.

12. The process of claim 4, wherein the jacket is steel and the wrapping foil is tantalum.

* * * * *